United States Patent [19]

Jundt et al.

[11] Patent Number: 4,528,957

[45] Date of Patent: Jul. 16, 1985

[54] METHOD AND APPARATUS FOR CONTROLLING THE AIR-FUEL RATIO OF THE OPERATING MIXTURE OF AN INTERNAL COMBUSTION ENGINE

[75] Inventors: Werner Jundt, Ludwigsburg; Rolf Reischl, Stuttgart, both of Fed. Rep. of Germany

[73] Assignee: Robert Bosch GmbH, Stuttgart, Fed. Rep. of Germany

[21] Appl. No.: 610,108

[22] Filed: May 14, 1984

[30] Foreign Application Priority Data

May 28, 1983 [DE] Fed. Rep. of Germany ..... 3319432

[51] Int. Cl.[3] ..... F02M 7/00

[52] U.S. Cl. ..... 123/440; 123/489

[58] Field of Search ..... 123/440, 489

[56] References Cited

U.S. PATENT DOCUMENTS

| | | | |
|---|---|---|---|
| 4,174,689 | 11/1979 | Hosaka | 123/440 |
| 4,208,993 | 6/1980 | Peter | 123/440 |
| 4,345,562 | 8/1982 | Drews et al. | 123/489 X |
| 4,393,841 | 7/1983 | Drews et al. | 123/489 X |

*Primary Examiner*—Tony M. Argenbright

*Attorney, Agent, or Firm*—Walter Ottesen

[57] ABSTRACT

The invention is directed to a method and an apparatus for controlling the air-fuel ratio of the operating mixture supplied to an internal combustion engine. The apparatus includes an oxygen sensor that is responsive to the oxygen content of the burnt operating mixture. The operating state of the sensor is detected by superposing a constant reference quantity on the oxygen sensor output quantity. The resultant of these quantities is fed to at least two comparators having different thresholds. The comparator outputs are processed to detect the operational readiness of the sensor. In this arrangement, the air-fuel ratio of the operating mixture is adjustable in dependence on the output quantity of the comparator to which the higher threshold is applied. This upper threshold and the special course of the Lambda sensor output voltage coact to compensate for the lean shift of the Lambda control during the warm-up phase of the internal combustion engine. In addition, this method largely avoids the transient response behavior of the control apparatus referred to as "idle hunting" without necessitating additional circuit configurations. The use of the higher one of the two thresholds as the control threshold results in a significant improvement of the behavior of the internal combustion engine during the warm-up phase.

3 Claims, 4 Drawing Figures

METHOD AND APPARATUS FOR CONTROLLING THE AIR-FUEL RATIO OF THE OPERATING MIXTURE OF AN INTERNAL COMBUSTION ENGINE

FIELD OF THE INVENTION

This invention relates to a method and apparatus for controlling the air-fuel ratio of the operating mixture supplied to an internal combustion engine wherein an oxygen sensor (Lambda sensor) responsive to the oxygen content of the burnt operating mixture is used. For the purpose of detecting the operational readiness of the sensor, a constant reference quantity is superposed on the output quantity of the oxygen sensor. The resultant quantity is fed to at least two comparators having different thresholds and the comparator outputs are further processed to detect the operational readiness of the sensor.

BACKGROUND OF THE INVENTION

A method of the type described above and an apparatus for implementing the method are known, for example, from U.S. Pat. No. 4,208,993. The apparatus of this invention makes it possible to reliably detect the sensor output voltage, which is indicative of the mixture composition, even when the sensor is still very cold. The apparatus evaluates this voltage and makes it available as an actual value for determining the composition of the operating mixture without the need to supply a reference signal. In this way and in spite of the disturbance caused by the temperature-responsive internal resistance of the oxygen sensor, an actual value of the mixture composition can be determined and a corresponding control signal generated also in the warm-up phase of the oxygen sensor after the temperature has reached a specific magnitude. The output signals of the two comparators, which monitor the resultant voltage of the oxygen sensor output voltage and the constant reference voltage, serve as input information for a digital evaluation circuit which ensures a recognition of the operational readiness of the oxygen sensor.

In addition, it follows from German patent application DE-OS No. 31 49 136 (published June 23, 1983) that the output voltage of the threshold switch together with the lower threshold is used to define the direction of action of the regulator towards a rich or a lean mixture. Therefore, the lower threshold voltage is also referred to as the control threshold since the comparison between the oxygen sensor output voltage and this threshold voltage is already sufficient to define the course of action of the regulator.

This known arrangement, however, is characterized by a peculiarity ensuing from the special pattern of the resultant voltage of the oxygen sensor output voltage and the constant reference voltage as a function of temperature. More specifically, the lean branch of the oxygen sensor e.m.f. has been shown to experience a shift towards the rich branch at low temperatures.

As a result, the presence of a rich mixture is always simulated to the control unit even if it is in fact a lean mixture, so that the control unit will correct the mixture to ever leaner values until the lean misfire limit is reached.

It is apparent that an unfavorable engine behavior will ensue from such an operating mixture setting in particular during the warm-up phase. In addition, when the lower threshold is used as the control threshold, a phenomenon occurs which may be described as "idle hunting". This is the case when, during the warm-up phase, the stage which recognizes the operational readiness of the sensor continuously oscillates between an open-loop and a closed-loop control of the operating mixture.

SUMMARY OF THE INVENTION

By contrast, the method of the invention for controlling the air-fuel ratio and the apparatus of the invention for conducting the steps of the method afford the advantages of compensating for the lean shift of the air-fuel mixture during the warm-up phase and of largely avoiding "idle hunting".

It is a particular advantage of the invention that this method can be readily implemented using known circuit configurations thereby obviating the need for new components or circuit configurations.

The essence of the invention is based on the realization that utilization of the lower threshold as the switching threshold is particularly disadvantageous and that it has been shown to be particularly suitable to use the upper threshold as the control threshold instead. Only the use of the upper threshold as the control threshold will provide for compensation of the lean shift during the warm-up phase pursuant to the invention. This compensation results from the special cooperation between the control threshold and the temperature-responsive course of the sensor output voltage.

BRIEF DESCRIPTION OF THE DRAWING

The invention will now be described with reference to the drawing wherein.

DESCRIPTION OF THE PREFERRED EMBODIMENTS OF THE INVENTION

Figure 1:
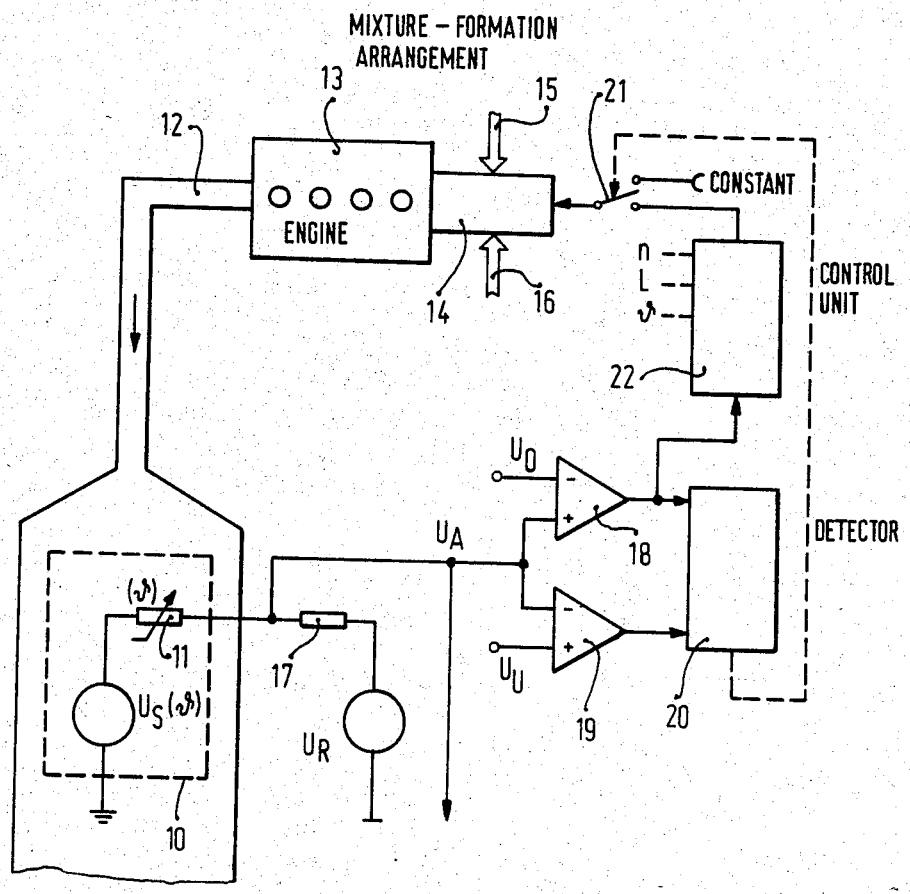
FIG. 1 is a simplified block diagram showing an embodiment of the apparatus of the invention.

Referring now to FIG. 1, reference numeral 10 identifies the equivalent circuit of an oxygen sensor as described, for example, in U.S. Pat. No. 4,208,993. For the aspects essential to this invention, it will suffice to represent the oxygen sensor 10 as an equivalent circuit including voltage source $U_S$, which is dependent on temperature and on the exhaust gas, connected in series with a temperature-dependent resistor 11. The oxygen sensor 10 is arranged in the exhaust pipe 12 of an internal combustion engine 13 that receives its operating mixture from a mixture-formation arrangement 14 which determines the ratio of air 15 to fuel 16.

Oxygen sensor 10 has one terminal connected to ground potential while its other terminal is connected to a voltage source $U_R$ via a resistor 17. From the connecting node between resistors 11 and 17, a conductor is connected to the non-inverting input of a comparator 18 as well as to the inverting input of a comparator 19. A threshold voltage $U_O$ is applied to the inverting input of comparator 18; whereas, a threshold voltage $U_U$ is applied to the non-inverting input of comparator 19. The outputs of comparators 18, 19 control a detector 20 for detecting sensor condition. The detector 20, in turn, actuates an arrangement schematically represented as switch 21. If the detector 20 senses that the oxygen sensor 10 is not ready for operation, the switch 21 interrupts the closed-loop control and switches to an open-loop control. The output of comparator 18 is also fed to a control unit 22 which, in turn, controls the mixture-formation arrangement 14 via switch 21. The threshold voltages $U_O$, $U_U$ are conventionally dimensioned to be in symmetry with respect to voltage $U_R$ so that the two threshold values are separated by a voltage difference $\Delta U$. As indicated by the broken-line arrows, further engine parameters such as load L, temperature $\theta$ or engine speed n may be applied to control unit 22 as inputs thereby influencing the operation of the latter. The control unit 22 exhibits a P-type, I-type or D-type control action or a combination of these control characteristics.

Figure 2:
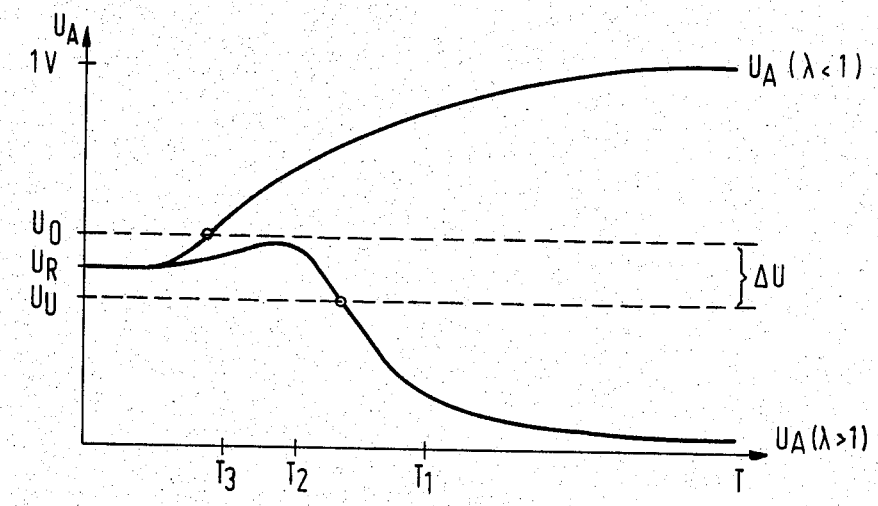
FIG. 2 is a graphical representation of the resultant voltage $U_A$ plotted as a function of the temperature of the oxygen sensor, showing both the rich ($\lambda < 1$) and the lean ($\lambda > 1$) branch.

In FIG. 2, the threshold positions are indicated by the broken lines. Further, FIG. 2 also shows the curve of the resultant voltage $U_A$ which is present at the node between resistors 11 and 17. The resultant voltage $U_A$ is plotted against the temperature for a lean mixture ($\lambda > 1$) and for a rich mixture ($\lambda > 1$). The special curve pattern results from the temperature-responsive variation of the electromotive force $U_S$ of the oxygen sensor on the one hand, and, on the other hand, from the temperature-responsive variation of resistor 11 relative to resistor 17 which is connected downstream of the reference voltage source $U_R$. At very low temperatures in the range of $T < T3$, the high internal resistance of resistor 11 causes voltage $U_A$ to be almost exclusively determined by the value of reference voltage $U_R$. As the temperature rises, causing internal resistance 11 to decrease, the circuit characteristic of the type of oxygen sensor used becomes an increasingly important factor. The general rule, however, is that the rich branch passes through the upper threshold $U_O$ at substantially lower temperatures than the lean branch does through the lower threshold $U_U$.

Since the temperature of an oxygen sensor fitted into the exhaust system of an internal combustion engine increases essentially linearly with time after starting, it will become apparent from FIG. 2 that the use of the upper threshold $U_O$ as the control threshold makes it necessary for the control function to commence substantially earlier than would be the case if the lower threshold $U_U$ were used as the control threshold.

The mode of operation of the apparatus of FIG. 1 will now be described. For voltages $U_A$ above the threshold $U_O$, control unit 22 corrects the air-fuel mixture towards a lean mixture. However, if voltage $U_A$ assumes values lying between the upper and the lower threshold values, control unit 22 will correct the composition of the air-fuel mixture towards a rich mixture. If voltage $U_A$ continues to be in the range between the two threshold values after a certain period of monitoring time, the sensor condition detector 20 will sense an inactive condition of the sensor and activate switch 21 which switches over to an open-loop control. If the closed-loop control is enabled for voltages $U_A$ below the lower threshold value $U_U$, control unit 22 will correct the composition of the air-fuel mixture towards a rich mixture. Thus, the direction in which control unit 22 will act depends solely upon the position of voltage $U_A$ relative to the upper threshold $U_O$. Therefore, this threshold is also referred to as the control threshold.

As the temperature increases, a transient response of the arrangement occurs which will be now described as follows.

At very low temperatures when voltage $U_A$ is within the range between the upper and lower threshold values $\Delta U$, that is, when the sensor voltage reaches neither one of the two thresholds, monitoring of the voltage will continue for a specific period of time after which the control apparatus will be switched to an open-loop control whereby the tendency will be toward a rich mixture. When the operating temperature of the oxygen sensor reaches values of the order of T3, the following occurs: comparator 18 will switch (under open-loop control, a rich mixture prevails); sensor condition detector 20 will determine a ready condition of the sensor and switch from open-loop to closed-loop control; and, control unit 22 will correct the mixture towards lean. As soon as voltage $U_A$ drops below threshold $U_O$, the control apparatus will correct the mixture back towards rich. By suitably dimensioning the apparatus, it is possible to have the voltage $U_A$ exceed the upper threshold $U_O$ already before the monitoring period has elapsed, which ensures continued operation of the closed-loop control. In this manner, "idle hunting" as described, for example, in German patent application DE-OS No. 31 49 136 (published June 23, 1983) is avoided.

From FIG. 2 it becomes apparent further that in particular in the temperature range between $T_3$ and $T_2$ there is a marked shift towards a lean mixture during the warm-up phase, because the mean value between the two voltage branches for a rich and a lean mixture tends towards a rich value which the closed-loop control tries to compensate for. From this it follows that control unit 22 corrects the mixture to a leaner value on the time average. Only at temperatures $T > T_1$ will this lean shift move back towards zero.

Figure 3:
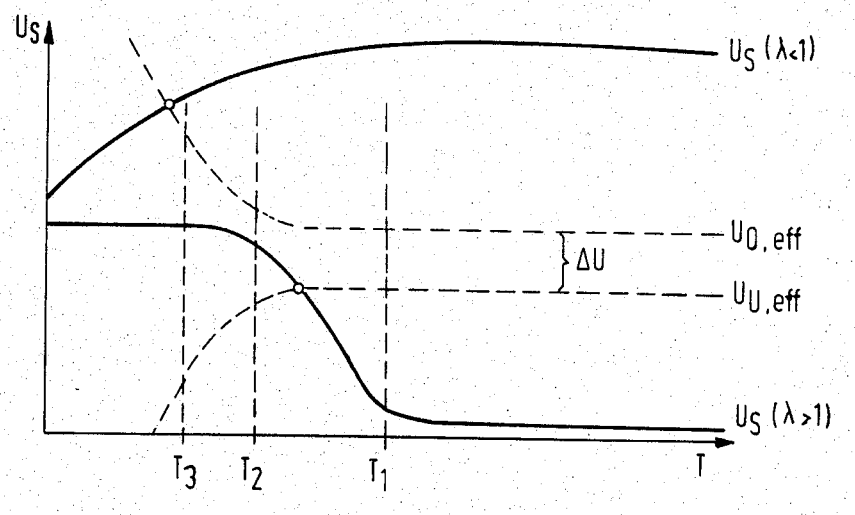
FIG. 3 is a graphical representation of the electromotive force $U_S$ of the oxygen sensor plotted as a function of temperature, showing both the rich and the lean branches; and, FIG. 4 is a graphical representation of the electromotive force $U_S$ of the oxygen sensor plotted as a function of Lambda ($\lambda$) and with temperature T as parameter.

In order to illustrate the influence that the selected control threshold has on the degree of lean shift, other parameters were selected in FIG. 3. The graph of FIG. 3 is also a plot of voltage as a function of temperature wherein the two branches represent the electromotive force $U_S$ of oxygen sensor 10. In FIG. 3, the influence of the internal resistance 11 of the oxygen sensor, which is highly dependent on temperature, is initially neglected. Instead, internal resistance 11 was taken into account in the effective switching thresholds identified by $U_{O,eff}$ and $U_{U,eff}$. These thresholds are defined as the electromotive force $U_S$ of oxygen sensor 10 which is necessary to make $U_A$ reach the thresholds $U_O$, $U_U$.

As will be seen from FIG. 1, the presence of very low temperatures at which internal resistance 11 becomes very high requires extremely high positive or negative values of electromotive force $U_S$ in order to act on voltage $U_A$ via the voltage divider made up of resistors 11, 17 such that it attains either one of the two thresholds. The equivalence of FIGS. 2 and 3 will become apparent from the fact that the intersections between the branches representing a rich (lean) mixture and the upper (lower) threshold occur at the same temperature in both FIGS. This special pattern of effective switching thresholds accounts for the different degree of lean shift during the warm-up phase.

Figure 4:
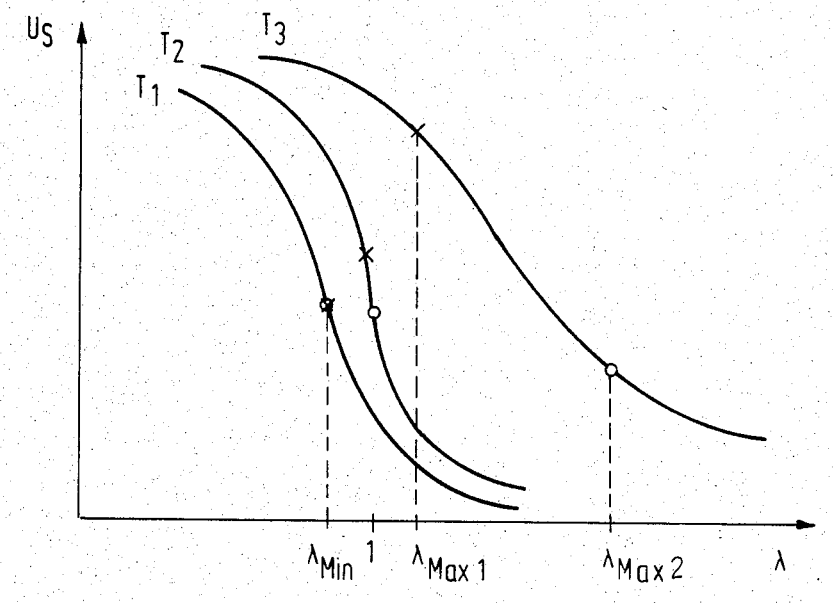

In FIG. 4, the electromotive force $U_S$ of the oxygen sensor is plotted as a function of Lambda. The three different characteristic curves apply to temperatures $T_3$, $T_2$ and $T_1$, respcetively. when the plot of the effective upper switching threshold $U_{O,eff}$ is entered in FIG. 4, the value of Lambda will vary between $\lambda_{Max1}$ and $\lambda_{Min}$ over the temperature range between $T_3$ and $T_1$. On the other hand, entering the effective lower control threshold $U_{U,eff}$, increased by $\Delta U$, in the graph of FIG. 4, no variation will result for high temperatures as is to be expected. For lower temperatures, however, substantially higher variation of the value of Lambda will occur ranging between $\lambda_{Max2}$ and $\lambda_{Min}$ over the same temperature range from $T_3$ to $T_1$.

This representation shows that by making a reasonable selection of the control threshold of the control apparatus, the lean shift of the mixture, which occurs particularly in the warm-up phase, is substantially reduced. It is noted that the implementation of this compensation method permits the use of known arrangements without the need for additional circuit configurations.

It is understood that the arrangement of the invention is suitable for use with any type of mixture-formation arrangement 14, whether for carburetors operating under open or closed loop control or for continuous or intermittent injection systems, for example.

It is further understood that the foregoing description is that of the preferred embodiments of the invention and that various changes and modifications may be made thereto without departing from the spirit and scope of the invention as defined in the appended claims.

What is claimed is:

1. Method of controlling the air-fuel ratio of the operating mixture supplied to an internal combustion engine wherein an oxygen sensor is provided which responds to the oxygen component of the burnt operating mixture exhausted by the engine, the method comprising the steps of:

superposing a constant reference quantity $U_R$ on the output quantity of $U_S$ of the sensor to form the resultant quantity $U_A$;

supplying the resultant quantity $U_A$ to a first input of a first comparator and to a first input of a second comparator, the first comparator having a second input for receiving an upper threshold quantity $U_O$ and the second comparator having a second input for receiving a lower threshold quantity $U_U$, said upper threshold quantity $U_O$ being greater than said lower threshold quantity $U_U$;

applying the respective output quantities of said comparators to a detector for processing the same to monitor and detect the operational readiness of the oxygen sensor;

applying the output quantity of said first comparator to a control unit for processing said output signal to develop a control signal dependent upon the latter for adjusting the air-fuel ratio of the operating mixture supplied to the engine; and, processing the output quantity of said first comparator to develop said control signal for changing said air-fuel ratio of the operating mixture in the direction of a lean composition for values of said output quantity corresponding to a value of said resultant quantity $U_A$ greater than said upper threshold quantity $U_O$.

2. Method of controlling the air-fuel ratio of the operating mixture supplied to an internal combustion engine wherein an oxygen sensor is provided which responsd to the oxygen component of the burnt operating mixture exhausted by the engine, the method comprising the steps of:

superposing a constant reference quantity $U_R$ on the output quantity $U_S$ of the sensor to form the resultant quantity $U_A$;

supplying the resultant quantity $U_A$ to a first input of a first comparator and to a first input of a second comparator, the first comparator having a second input for receiving an upper threshold quantity $U_O$ and the second comparator having a second input for receiving a lower threshold quantity $U_U$, said upper threshold quantity $U_O$ being greater than said lower threshold quantity $U_U$;

applying the respective output quantities of said comparators to a detector for processing the same to monitor and detect the operational readiness of the oxygen sensor;

applying the output quantity of said first comparator to a control unit for processing said output signal to develop a control signal dependent upon the latter for adjusting the air-fuel ratio of the operating mixture supplied to the engine; and processing the output quantity of said first comparator to develop said control signal for changing said air-fuel ratio of the operating mixture in the direction of a rich composition for values of said output quantity corresponding to a value of said resultant quantity $U_A$ less than said upper threshold quantity $U_O$.

3. Method of controlling the air-fuel ratio of the operating mixture supplied to an internal combustion engine wherein an oxygen sensor is provided which responds to the oxygen component of the burnt operating mixture exhausted by the engine, the method comprising the steps of:

superposing a constant reference quantity $U_R$ on the output quantity $U_S$ of the sensor to form the resultant quantity $U_A$;

supplying the resultant quantity $U_A$ to a first input of a first comparator and to a first input of a second comparator, the first comparator having a second input for receiving an upper threshold quantity $U_O$ and the second comparator having a second input for receiving a lower threshold quantity $U_U$, said upper threshold quantity $U_O$ being greater than said lower threshold quantity $U_U$;

applying the respective output quantities of said comparators to a detector for processing the same to monitor and detect the operational readiness of the oxygen sensor, the detector monitoring the operational readiness of the sensor for a predetermined period of time which is adjustable and, during which period, the resultant quantity $U_A$ has a value lying between the upper and lower threshold quantities ($U_O$, $U_U$);

applying the output quantity of said first comparator to a control unit for processing said output signal to develop a control signal dependent upon the latter for adjusting the air-fuel ratio of the operating mixture supplied to the engine; and, processing the output quantity of asid first comparator fed to said control unit to develop a control signal dependent thereon for adjusting said operating mixture to be constant in the rich range during said period.

* * * * *

UNITED STATES PATENT AND TRADEMARK OFFICE

CERTIFICATE OF CORRECTION

PATENT NO. : 4,528,957

DATED : July 16, 1985

INVENTOR(S) : Werner Jundt and Rolf Reischl

It is certified that error appears in the above-identified patent and that said Letters Patent is hereby corrected as shown below:

In column 3, line 17, delete "θ" and substitute -- $\vartheta$ -- therefor.

In column 3, line 28, after "mixture", delete "(λ>1)" and substitute -- (λ<1) -- therefor.

In column 5, line 1, delete "respcetively.when" and substitute -- respectively. When -- therefor.

In column 5, line 66, delete "responsd" and substitute -- responds -- therefor.

In column 6, line 61, delete "asid" and substitute -- said -- therefor.

Signed and Sealed this

*Twentieth* Day of *May 1986*

[SEAL]

*Attest:*

DONALD J. QUIGG

*Attesting Officer*

*Commissioner of Patents and Trademarks*